United States Patent [19]

Bernstein et al.

[11] 3,964,009

[45] June 15, 1976

[54] AC RADIATION CHOKE INSULATOR

[76] Inventors: Elliot Bernstein, Rockville Center, N.Y.; Richard Rosenberg, Paramus, N.J.

[73] Assignee: Bel Fuse Inc., Jersey City, N.J.

[22] Filed: Nov. 3, 1975

[21] Appl. No.: 628,327

[52] U.S. Cl. ..... 336/90; 174/52 R; 336/92; 336/229

[51] Int. Cl.[2] ..... H01F 27/02

[58] Field of Search ..... 336/90, 92, 229, 209; 174/138 F, 52 R, 92

[56] References Cited

UNITED STATES PATENTS

| | | | |
|---|---|---|---|
| 2,915,723 | 12/1959 | Wennerberg | 336/229 X |
| 3,493,908 | 2/1970 | Byers et al. | 336/229 X |
| 3,846,725 | 11/1974 | Mears, Jr. | 336/92 |

*Primary Examiner*—Thomas J. Kozma
*Attorney, Agent, or Firm*—Ostrolenk, Faber, Gerb & Soffen

[57] ABSTRACT

An A.C. anti-radiation choke coil for a device such as a television set is inserted in a metal can and positioned and insulated therein by a hinged container of insulating material that closely encloses the choke coil; each section of the hinged container is provided with a part of a tubular extension which, when the container is closed, provides a full tubular conduit for the leads of the coil, spacing the leads, electrically and mechanically, from the edges of the opening in the can through which the leads extend.

3 Claims, 9 Drawing Figures

AC RADIATION CHOKE INSULATOR

The present invention relates to A.C. chokes and more particularly to radiation chokes used primarily in the power supply to a television set to prevent radiation from being reflected back through the power line to other areas and other devices.

Essentially the A.C. choke or anti-radiation choke is a bifilar toroid shielded by a metallic can and so arranged that the power line is connected to the input of the bifilar coil and the output of the bifilar coil is connected to the power supply system in the television set.

One of the problems which arises in the utilization of such A.C. chokes or anti-radiation chokes is the appropriate insulation of the bifilar toroidally wound coil so that it may be properly contained within the shielded can and be, in effect, encapsulated therein. Encapsulation processes however are time consuming and expensive and it is therefore desirable particularly since cost is a factor in every component of a television set to provide a simple means for insulating the bifilar toroidal coil in its metallic can or housing in the simplest possible manner.

The present invention is directed primarily, therefore, to the insulator or internal housing for the bifilar wound toroidal A.C. choke. Essentially the invention contemplates that a hinged insulating container preferably integrally hinged by the material of the container and having two pockets may receive and enclose the bifilar wound toroidal coil when the pockets of the hinged insulating container are rotated toward each other, with means provided at the end of the closed insulating container for a conduit for the wires which lead into and out of the toroidal coil, while at the same time providing a support for the wires and spacing them electrically from the outer container.

The primary object of the present invention therefore is to provide a simplified insulating structure for a metal housed A.C. radiation choke wherein the radiation choke is positioned within the metal housing in such manner that it is contained therein; and the structure which insulates and spaces the bifilar toroidal coil from the container and constitutes the insulating structure is essentially a pair of pockets which when mated together fully enclose the toroidal coil.

A further object of the invention is that the insulating pockets above set forth be hinged to each other so that they may merely be snapped closed around the toroidal coil prior to insertion of the entire enclosed structure into the metal container.

A further object of the invention is to so arrange the insulating pockets that each is provided with a half-tubular extension which, when the pockets are closed, mate with each other to form a tubular conduit through which the wires of the bifilar would toroidal coil may extend projecting from and spaced from the remainder of the metal container; and also, by means of flexible extensions, lock the liner assembly into the can.

The foregoing and other objects of the present invention will become apparent in the following description in which.

Figure 6:
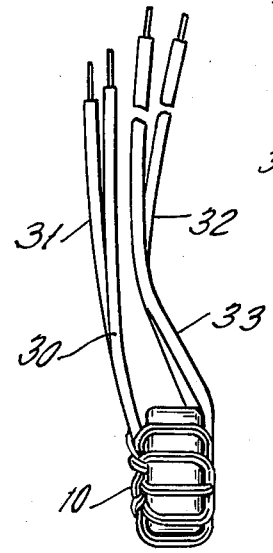
FIG. 6 is an end view of the same choke coil.
Figure 5:
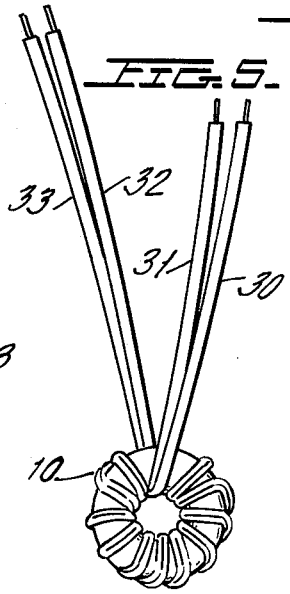
FIG. 5 is a side view of the bifilar toroidally wound A.C. radiation choke coil which is to be housed in the insulating container.
Figure 8:
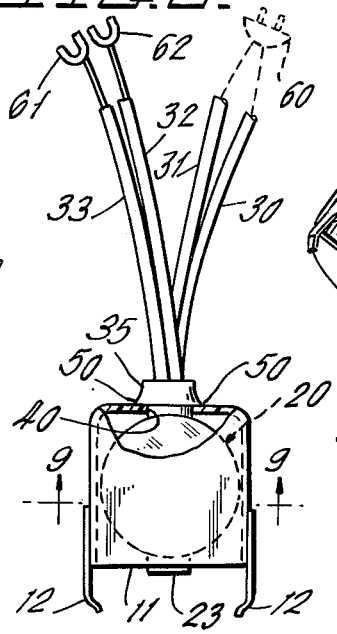
FIG. 8 is a side view of the metal container of FIG. 7 showing the toroidal coil structure fitted therein.
Figure 7:
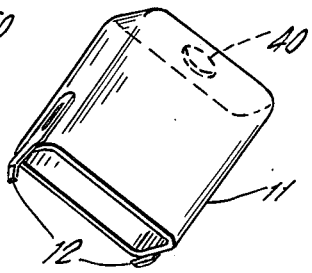
FIG. 7 is a view in perspective of the empty container or metal housing into which the toroidal coil is to be fitted.

Referring now to the drawings, FIGS. 5 and 6 show the type of A.C. radiation choke which is used in the structure of the present invention, and FIG. 7 is a view in perspective showing the housing 11 in which said anti-radiation choke 10 is to be fitted. The tangs 12 extending from housing or casing 11 are used to mount the unit within the television set or other device in which it is used.

As previously pointed out the major problem in encasing a coil of this type in a metal can is to provide an appropriate insulating spacing of the coil with respect to the can and a positioning of the coil in the can 11. The present invention is however directed to the insulator structure shown particularly in FIGS. 1, 2, 3 and 4 in which the toroidal coil of FIGS. 5 and 6 may be encased prior to insertion of the entire assembly into the can 11.

As seen in FIGS. 1, 2, 3 and 4 the insulating assembly comprises a pair of pocketed or recessed members 20 and 21 of insulating material and so shaped and dimensioned that when they are closed upon each other with the coil of FIG. 5 in the pockets they completely encase the coil 10 of FIG. 5 and provide a full insulating housing therefore. The dish-shaped or circular pockets 20 and 21 are preferably hinged together by the integral hinge 23 so that they may be molded or otherwise manufactured in one piece and nevertheless provide a simplified method of obtaining the complete enclosure of the toroidal coil 10.

Figure 4:
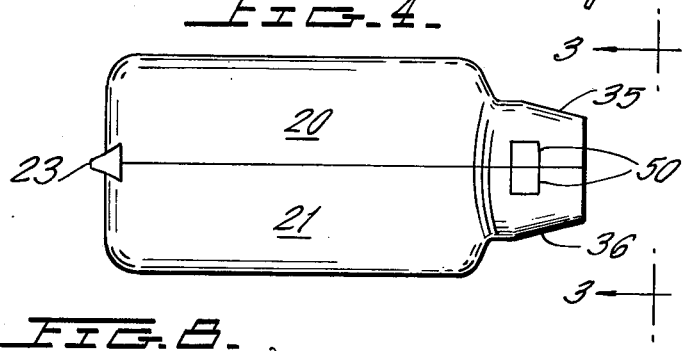
FIG. 4 is a view of the insulating container in closed condition.

When the coil 10 of FIG. 5 is placed for instance in the pocket 20, then, before the pocket 21 is rotated on the hinge 23 to the position of FIG. 4, the input lead wires 30 and 31 and the output lead wires 32 and 33 are placed in the half-tubular extension 35 of for instance the pocket 20. Then when the pocket 21 is hingedly rotated on the hinge 23 into the position of FIG. 4 the half-tubular extension 36 of pocket 21 meets with and joins the half-tubular extension of pocket 35 to form a full tubular extension which encases the leads 30–31 and 32–33.

Now when the enclosed structure of the type shown in FIG. 4 is inserted in the can the leads 30, 31 32, 33 are led through the opening 40 in the can 11 owing to the fact that the tubular extension 35–36 of the enclosing insulating structure may be forced through the said opening 40 in order to lock the now enclosed and thoroughly insulated toroidal coil FIG. 5 in position in the can so that it may not be withdrawn.

Each of the half-tubular extensions 35 and 36 of the insulating structure 20–21 is provided with a flexible extension 50,50 on each side which may be compressed as the tube 35–36 is forced through the opening 40 and then snaps on the outer side of the opening 40 of the can 11 thereby causing the completed encased toroidal coil to be positioned in the can by the structure of the tube 35–36 itself.

The dimensions of the insulating member of FIGS. 1 through 4 and the pockets 20, 21 are chosen so that the completed insulating structure will suitably fit in the can 11.

Figure 1:
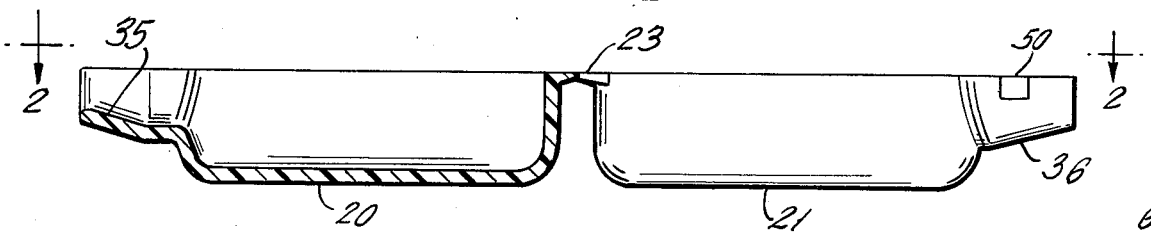
FIG. 1 is a side view in cross-section of the hinged insulating spacer of the present invention.
Figure 2:
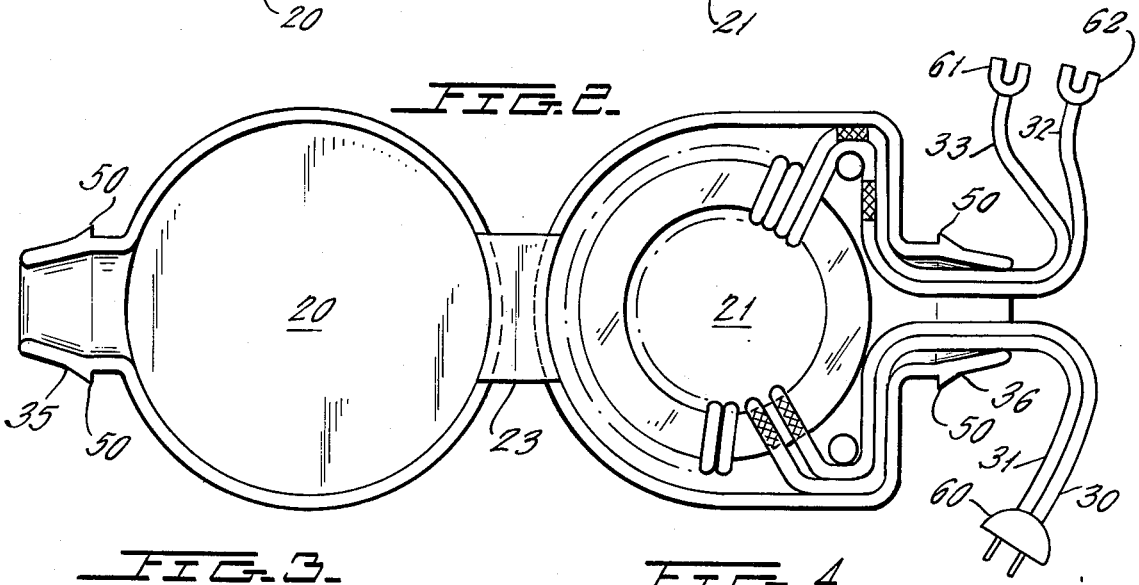
FIG. 2 is a plan view of the hinged insulating spacer container of FIG. 1 taken from line 2—2 of FIG. 1.
Figure 3:
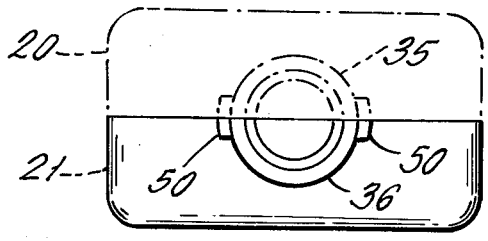
FIG. 3 is an end view taken from lines 3—3 of FIG. 4 looking in the direction of the arrows.

The power supply cord may be led directly into the inside of the insulator housing 20, 21 and the can 11 to the toroidal coil as shown in FIG. 2. The output leads 32, 33 may then be connected in any suitable manner as by the connectors 61, 62 to the power supply in the television set.

Figure 9:
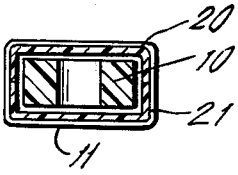
FIG. 9 is a cross-sectional view taken from line 9—9 of FIG. 8 looking in the direction of the arrows.

By this means therefore a simplified insulating structure for an A.C. radiation choke in its can is provided by which, in effect, the toroidal coil is enclosed and positioned in the can without going through an expensive time-consuming process. The enclosure, as previously pointed out, comprises the hinged pocketed insulating members each with a half tube which when placed together or rotated into conjunction with each other will completely encase and house the toroidal coil 10 of FIGS. 5 and 6 with the half-tubular members, together, forming the tube through which the leads 30, 31, 32, 33 may be led. The entire insulating structure is so dimensioned that internally it will position the toroidal coil 10 while externally it will fit the interior of the can 11 of FIG. 7. Therefore it is desirable that the material of which the insulating structure of FIGS. 1–4 is formed not only have appropriate dielectric strength but also be sufficiently flexible to permit a close fit of the insulating material around the toroidal coil 10 to occur as well as to permit the snap lock (by extension 50) of the entire enclosed structure of FIG. 4 within the can 11 as shown in FIG. 9.

In the foregoing the invention has been described solely in connection with preferred illustrative embodiments thereof. Since many variations and modifications of this invention will now be apparent to those skilled in the art, it is preferred that the scope of this invention be defined, not by the specific disclosures herein contained, but only by the appended claims.

The embodiments of the invention in which an exclusive privilege or property is claimed are defined as follows:

1. In a toroidal choke coil encased in a metal container; an opening in the container; said coil having leads; said leads extending through said opening in the container; the improvement comprising:

an insulating receptacle receiving said toroidal choke coil, said insulating receptacle comprising two sections enclosing said coil;

said sections of said insulating receptable encasing and positioning said coil between them;

said combined sections fitting within said metal container;

each section of said insulating receptacle being provided with a part tubular extension; said part tubular extensions of each said sections combining to form a tubular member;

said leads extending through said tubular member, said tubular member extending through said opening in said metal container.

2. The toroidal choke coil of claim 1 in which said sections forming said insulating receptacle are of compressible material; the said coil being positioned in said metal container and insulated therefrom;

said tubular member having a detent member passing through said hole in said metal container from the interior of said metal container to the exterior thereof;

said detent flexing as said tubular member is forced through said hole and engaging the outer side of said container to resist withdrawal of said insulating receptacle from said metal container and to position said coil and insulating receptacle in said container.

3. The toroidal coil of claim 2 in which the said sections of said insulating receptacle are hinged together; the part tubular extension of each said section extending from each section at the side thereof opposite the hinge.

* * * * *